US008682204B2

(12) United States Patent
Fujiya et al.

(10) Patent No.: US 8,682,204 B2
(45) Date of Patent: Mar. 25, 2014

(54) IMAGE FORMING APPARATUS HAVING HEAT RADIATING UNIT

(75) Inventors: Hiromitsu Fujiya, Kanagawa (JP); Kenichi Takehara, Kanagawa (JP); Yasuaki Iijima, Kanagawa (JP); Keisuke Yuasa, Kanagawa (JP); Satoshi Okano, Kanagawa (JP); Masanori Saitoh, Tokyo (JP); Shingo Suzuki, Kanagawa (JP); Tomoyasu Hirasawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 496 days.

(21) Appl. No.: 12/926,973

(22) Filed: Dec. 21, 2010

(65) Prior Publication Data

US 2011/0170895 A1 Jul. 14, 2011

(30) Foreign Application Priority Data

Jan. 14, 2010 (JP) ..... 2010-005567
Sep. 29, 2010 (JP) ..... 2010-218157

(51) Int. Cl.
*G03G 21/20* (2006.01)

(52) U.S. Cl.
USPC ..... 399/94

(58) Field of Classification Search
USPC ..... 399/94
See application file for complete search history.

(56) References Cited

U.S. PATENT DOCUMENTS 5,086,829 A * 2/1992 Asakawa ..... 165/270
7,224,921 B2 5/2007 Iijima et al.
7,356,277 B2 4/2008 Iijima et al.
2002/0191982 A1* 12/2002 Tsukamoto et al. ..... 399/94
2005/0088820 A1* 4/2005 Naganawa et al. ..... 361/697
2009/0269099 A1 10/2009 Takehara
2010/0008694 A1 1/2010 Okano et al.
2010/0008695 A1 1/2010 Okano et al.
2010/0183323 A1* 7/2010 Fujiya et al. ..... 399/44
2011/0030927 A1 2/2011 Okano et al.

FOREIGN PATENT DOCUMENTS

EP 0 282 353 9/1988
EP 2 144 125 A1 1/2010
JP 2006-003628 A 1/2006
JP 2006091095 A * 4/2006
JP 2007-293111 11/2007

OTHER PUBLICATIONS

Search Report dated May 19, 2011 for corresponding European Patent Application No. EP 10 197 174.

* cited by examiner

*Primary Examiner* — David Gray
*Assistant Examiner* — Andrew Do
(74) *Attorney, Agent, or Firm* — Harness, Dickey & Pierce

(57) ABSTRACT

An image forming apparatus includes an image forming unit that creates an image and a liquid cooling unit. The liquid cooling unit includes a heat receiving disposed in contact with a temperature rising portion, in the image forming unit, in which a temperature rises due to an image forming operation by the image forming unit, a heat radiating unit that radiates heat of a cooling liquid, a flow passage forming member that allows the cooling liquid to circulate between the heat receiving unit and the heat radiating unit, and a conveying unit that conveys the cooling liquid through the flow passage forming member. The heat radiating unit includes a radiator, and the radiator is disposed at a downstream side of the conveying unit in a cooling liquid flow direction and at an upstream side of the heat receiving unit in the cooling liquid flow direction.

12 Claims, 11 Drawing Sheets

IMAGE FORMING APPARATUS HAVING HEAT RADIATING UNIT

CROSS-REFERENCE TO RELATED APPLICATIONS

The present application claims priority to and incorporates by reference the entire contents of Japanese Patent Application No. 2010-005567 filed in Japan on Jan. 14, 2010 and Japanese Patent Application No. 2010-218157 filed in Japan on Sep. 29, 2010.

BACKGROUND OF THE INVENTION

1. Field of the Invention

The present invention relates to an image forming apparatus such as a printer, a facsimile, and a copy machine.

2. Description of the Related Art

In connection with an image forming apparatus, it is known that units such as a writing unit, a fixing unit, and a developing unit that are disposed in an image forming unit within the apparatus generate heat and increase the internal temperature of the apparatus.

For example, in the developing unit, when a developer stirring and conveying member for stirring and conveying a developer inside the developing unit is driven, frictional heat generated by sliding friction between the developer stirring and conveying member and the developer, or between the developers increases the internal temperature of the apparatus. Frictional heat generated by sliding friction between a developer and a developer regulating member for regulating the layer thickness of the developer carried on a developer carrier before the developer is conveyed to a developing area also increases the internal temperature of the apparatus. Furthermore, when the developer regulating member regulates the thickness of the developer, frictional heat generated by sliding friction between developers increases the internal temperature of the apparatus.

An increase in temperature may cause the toner to melt and be fixed onto the developer regulating member, the developer carrier, the image carrier, or the like, so an image with a stripe-like abnormal defect may be produced. Further, even though the toner is not melted, the toner having an increased temperature gets stressed from pressure or friction. Thus, there may be a problem in that an external additive on the toner surface comes to be buried into the inside of toner or be separated from the surface, which causes the toner component to stick to the carrier surface. This problem may lead to a lack of stability in developing capability in the long term. Particularly, in the case of using the toner having the low melting temperature to reduce fixing energy, an abnormal image may be easily generated due to fixing of the toner.

For this reason, there has been known an image forming apparatus in which external air is introduced into the apparatus by an air-cooling fan and is conveyed to the periphery of the developing unit through a duct to air-cool the developing unit and thereby to prevent an excessive increase in temperature. However, as the size of the image forming apparatus decreases, the density inside the apparatus increases and a space around the developing unit also decreases. Therefore, it becomes more difficult to reserve a space for the duct for conveying the air current from the air-cooling fan to the periphery of the developing unit. Therefore, it becomes difficult to forcedly air-cool the developing unit.

Japanese Patent Application Laid-open No. 2006-003628 discloses an image forming apparatus using a liquid cooling system in which a developing unit is cooled by circulation of a liquid. A liquid cooling apparatus includes: a heat receiving unit; a heat radiating means for radiating the heat of the cooling liquid; a tube disposed to allow the cooling liquid to circulate through the heat receiving unit and the heat radiating means; and a conveying means for conveying the cooling liquid inside the tube. The heat receiving unit is in close contact with the wall surface of the developing unit that is a temperature increasing portion to receive heat from the developing unit by a cooling liquid therein. The liquid cooling apparatus can perform cooling more effectively than the air cooling apparatus and thus effectively cool the developing unit. Further, since the tube for circulating the cooling liquid has a smaller cross section than the duct, even if the space around the developing unit is cramped, the tube can be disposed around the developing unit. Thus, even if the component density inside the apparatus increases, the developing unit may be cooled down.

However, if the cooling liquid conveyed inside the tube by the conveying means pulsates, the pulsation of the cooling liquid causes the heat receiving unit to vibrate, and the vibration is transferred to the image forming unit via the developing unit. This has a bad influence on an image forming operation, so that a good image cannot be formed.

The writing unit and the fixing unit disposed in the imaging unit as the temperature increasing portions have the same problem as described above.

According to the present invention, since the cooling liquid flows from the conveying unit to the heat receiving unit via the radiator, the pulsation generated in the cooling liquid is attenuated by the conveying unit while the cooling liquid flows through the complicated flow passage in the radiator before the cooling liquid is sent to the heat receiving unit. This reduces the vibration that is generated in the heat receiving unit due to the pulsation of the cooling liquid. The vibration to be transferred to the image forming unit via the temperature increasing portion is reduced. Accordingly, it is possible to prevent the phenomenon that good image formation cannot be performed since the vibration has a bad influence on the image forming operation.

SUMMARY OF THE INVENTION

It is an object of the present invention to at least partially solve the problems in the conventional technology.

According to an aspect of the present invention, an image forming apparatus comprises: an image forming unit that creates an image; and a liquid cooling unit that includes: a heat receiving unit that is disposed in contact with a temperature rising portion, in the image forming unit, in which a temperature rises due to an image forming operation by the image forming unit, a heat radiating unit that radiates heat of a cooling liquid, a flow passage forming member that forms a flow passage that allows the cooling liquid to circulate between the heat receiving unit and the heat radiating unit; and a conveying unit that conveys the cooling liquid inside the flow passage forming member, and the heat radiating unit includes a radiator, and the radiator is disposed at a downstream side of the conveying unit in a cooling liquid flow direction and at an upstream side of the heat receiving unit in the cooling liquid flow direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

Hereinafter, a first embodiment of an image forming apparatus according to the present invention will be explained.

Figure 2:
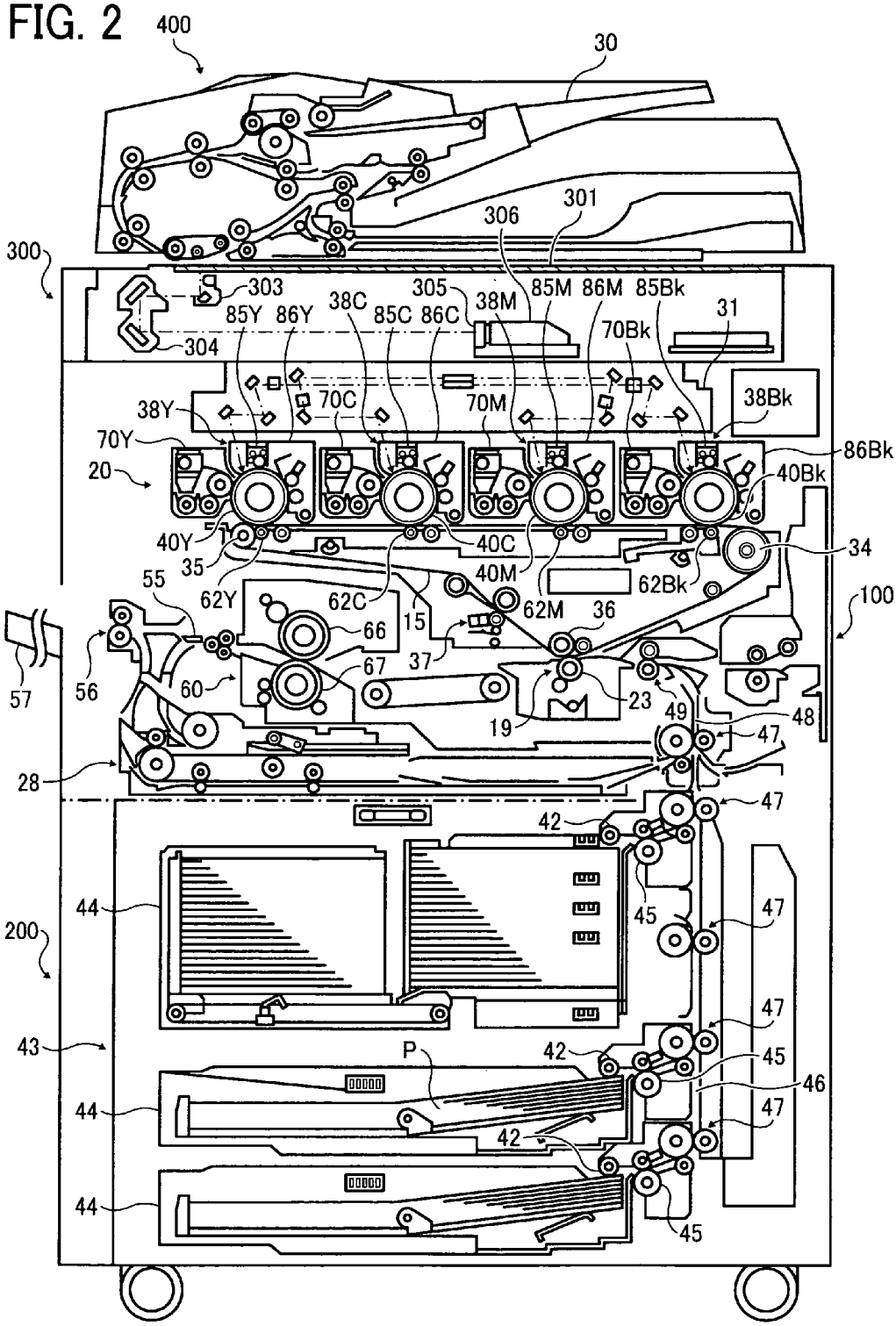
FIG. 2 is a structural view illustrating an example of an image forming apparatus according to an embodiment.

FIG. 2 is a structural view illustrating an example of an image forming apparatus according to the first embodiment. The image forming unit includes: an image forming unit 100 that creates an image and serves as an image forming apparatus body; a paper feeding table 200 on which the image forming unit 100 is stacked; a scanner 300 mounted on the image forming unit 100; and an automatic document feeder (ADF) 400 mounted on the scanner 300.

In the scanner 300, an original document (not shown) placed on a contact glass 301 is read and scanned in accordance with the reciprocation of a first traveling body 303 and a second traveling body 304. The first traveling body 303 carries: a light source for illuminating the original document with light; and a mirror. The second traveling body 304 carries a plurality of reflective mirrors. Scanning light emitted from the second traveling body 304 is focused on an imaging surface of a read sensor 306 by an imaging lens 305. Subsequently, the read sensor 306 disposed at the rear side of the imaging lens 305 reads the focused scanning light as an image signal.

In the image forming unit 100, photoreceptor drums 40Y, 40C, 40M, and 40Bk that correspond to colors of yellow (Y), cyan (C), magenta (M), and black (Bk), respectively, are disposed as latent image carriers. Units for performing an electronic-photographic process such as a developing apparatus 70 (including 70Y, 70C, 70M, 70BK that correspond to colors of yellow (Y), cyan (C), magenta (M), and black (Bk), respectively), a charging apparatus 85 (including 85Y, 85C, 85M, 85BK that correspond to colors of yellow (Y), cyan (C), magenta (M), and black (Bk), respectively), and a photoreceptor cleaning apparatus 86 are disposed around each of the photoreceptor drums 40 to form each image forming device 38 (including 38Y, 38C, 38M, 38BK that correspond to colors of yellow (Y), cyan (C), magenta (M), and black (Bk), respectively). Four image forming units 38 are disposed in parallel to form a tandem type image forming unit 20.

In the developing apparatus 70 of each image forming device 38, a developer that contains toner of one of the four colors is used. In the developing apparatus 70, a developing sleeve 71 serving as a developer carrier carries and conveys the developer. The developing apparatus 70 is applied with an alternating electric field at a position facing the photoreceptor drum 40 and thus develops a latent image on the photoreceptor drum 40. By the application of the alternating electric field, the developer is activated and the charging distribution of the toner can be narrowed, which results in improvement of a developing property. The developing apparatus 70 and the photoreceptor drum 40 may be integrally supported together and disposed to be attached to or detached from the image forming unit 100 to form a process cartridge. Thus, the developing apparatus 70 and the photoreceptor drum 40 can be easily attached to or detached from the image forming unit 100, thereby improving maintainability. The process cartridge may further include a charging apparatus 85 and a photoreceptor cleaning apparatus 86.

An exposure apparatus 31 that makes the photoreceptor drum 40 to be exposed to laser beams or light emitting diode (LED) light to form a latent image based on image information is disposed above the tandem type image forming unit 20.

Below the tandem type image forming unit 20, an intermediate transfer belt 15 including an endless belt member is disposed facing the photoreceptor drum 40. The intermediate transfer belt 15 is supported by a support roller 34, a support roller 35, and a secondary transfer backup roller 36. At a neighboring position facing the photoreceptor drum 40 via the intermediate transfer belt 15, a primary transfer apparatus 62 for transferring a toner image of each color formed on the photoreceptor drum 40 onto the intermediate transfer belt 15 is disposed.

A secondary transfer apparatus 19 that collectively transfers the toner images superimposedly formed on the surface of the intermediate transfer belt 15 onto a transfer sheet P conveyed from a paper feeding cassette 44 of the paper feeding table 200 is disposed below the intermediate transfer belt 15. The secondary transfer apparatus 19 includes a secondary transfer roller 23 and a contacting and separating mechanism (not shown) that supports the secondary transfer roller 23 to contact or separate from the intermediate transfer belt 15. The secondary transfer apparatus 19 presses the secondary transfer roller 23 against the secondary transfer backup roller 36 via the intermediate transfer belt 15 and transfers the toner image on the intermediate transfer belt onto the transfer sheet P.

An intermediate transfer belt cleaning unit 90 is disposed in order to remove the toner remaining on the surface of the intermediate transfer belt 15. The intermediate transfer belt cleaning unit 90 makes, for example, a fur brush or a cleaning blade made of urethane rubber abut on the intermediate transfer belt 15 and scrapes to remove the secondary transfer residual toner adhered to the intermediate transfer belt 15.

A fixing apparatus 60 is disposed at a position neighboring to the secondary transfer apparatus 19. The fixing apparatus 60 fixes the image on the transfer sheet P. The fixing apparatus 60 mainly includes a heating roller 66 having a heater as a heat source therein and a pressing roller 67 that is pressed against the heating roller 66.

An inverting apparatus 28 for inverting the transfer sheet P is disposed below the secondary transfer apparatus 19 and the fixing apparatus 60. The inverting apparatus 28 inverts the transfer sheet P in order to record an image on both sides of the transfer sheet P.

FIG. 2 is a front view of the image forming apparatus. A far side in a direction orthogonal to the paper plane in the drawing is the rear side of the image forming apparatus, and a near side in the direction orthogonal to the paper plane in the drawing is the front side of the image forming apparatus. The left side in the drawing is the left side of the image forming apparatus, and the right side in the drawing is the right side of the image forming apparatus. An openable and closable front door (not shown) is disposed at a front portion of a chassis of the image forming apparatus. When the front door is open, the front side of each of the image forming devices 38 is exposed to the outside. By slidingly moving the image forming units from the rear side to the front side of the image forming apparatus in the state the front side is exposed to the outside, each of the image forming devices 38 can be taken out of the image forming unit 100. A rear portion of the chassis of the image forming apparatus is provided with rear side plate (not shown).

Next, an operation of the image forming apparatus having the above described structure will be explained. The original document is set on a platen 30 of the automatic document feeder 400 of FIG. 2. Alternatively, the automatic original document feeder 400 is opened, the original document is set on the contact glass 301 of the scanner 300, and the automatic document feeder 400 is closed. In this state, a start switch (not shown) is pressed. At this time, when the original document is set on the automatic document feeder 400, after the original document is conveyed and placed on the contact glass 301, the scanner 300 is driven. On the other hand, when the original document is set on the contact glass 301, the scanner 300 is immediately driven. When the scanner 300 is driven, the first traveling body 303 and the second traveling body 304 are driven to travel. The first traveling body 303 emits light from the light source and receives reflected light from the original document surface. The first traveling body 303 reflects the received reflected light toward the second traveling body 304. The second traveling body 304 further reflects the reflected light from the mirror thereof. The reflected light is incident into the read sensor 306 through the imaging lens 305, and the read sensor 306 reads the content of the original document.

When the start switch of the apparatus is pressed, a driving motor (not shown) drives to rotate one of the support roller 34, the support roller 35, and the secondary transfer backup roller 36. At this time, the other two support rollers are passively rotated. Thus, the intermediate transfer belt 15 starts to revolve. At the same time, in each of the image forming devices 38, the photoreceptor drum 40 is uniformly charged by the charging apparatus 85. Subsequently, the photoreceptor drum 40 is irradiated with writing light such as a laser or an LED using the exposure apparatus 31 based on the content read by the scanner 300 to form an electrostatic latent image on each of the charged photoreceptor drums 40. The toner is supplied from the developing apparatus 70 to the photoreceptor drum 40 on which the electrostatic latent image is formed to convert the electrostatic latent image to a visible image. As a result, monochromatic images of black (Bk), yellow (Y), magenta (M), and cyan (C) are formed on the respective photoreceptor drums 40. The monochromatic images are primary transferred onto the intermediate transfer belt 15 in a superimposed manner by the primary transfer apparatus 62 (including 62Y, 62C, 62M, 62BK that correspond to colors of yellow (Y), cyan (C), magenta (M), and black (Bk), respectively) to form a combined color image on the intermediate transfer belt 15. After the image transfer, the residual toner on the surface of the photoreceptor drum 40 is removed by the photoreceptor cleaning apparatus 86, and the photoreceptor drum 40 is neutralized by a neutralizing apparatus (not shown) for preparing formation of a next image.

When the start switch is pressed down, one of paper feeding rollers 42 of the paper feeding table 200 is selected and rotated, the transfer paper P is continuously fed from one of the paper feeding cassettes 44 stacked in a paper bank 43 and separated, sheet by sheet, by a separating roller 45. The transfer paper P is inserted into a paper feeding path 46 and conveyed by a pair of conveying rollers 47 so that it is introduced into a paper feeding path 48 inside the image forming unit 100. The transfer paper P bumps against a pair of resist rollers 49 and stops. Next, at a timing that is synchronized with the combined color image on the intermediate transfer belt 15, the pair of resist rollers 49 rotates to send the transfer paper P into a position between the intermediate transfer belt 15 and the secondary transfer apparatus 19. The color image is transferred onto the transfer paper P by the secondary transfer apparatus 19.

The transfer paper P having a non-fixed toner image that has passed through the secondary transfer roller 23 is conveyed to the fixing apparatus 60. The image on the transfer paper P is fixed as a permanent image when heat and pressure is applied with the fixing apparatus 60. After the image fixing, the transfer paper P is switched by a switching claw 55, discharged by a pair of discharging rollers 56, and stacked on a discharge paper tray 57. Alternatively, the transfer paper P may be switched by the switching claw 55, introduced into the inverting apparatus 28, and inverted. The inverted transfer paper P is guided to a transfer position again, and an image is recorded on also the back surface of the transfer paper P. Next, the inverted transfer paper P is discharged to the discharge paper tray 57 by the discharging roller pair 56. After the image transfer is over, the residual toner remaining on the intermediate transfer belt 15 is removed by the intermediate transfer belt cleaning unit 90 to prepare for formation of a next image that is to be performed by the tandem type image forming unit 20.

If the image forming operation is continued for a long time, the temperature of the image forming device 38 rises due to heat generated from the photoreceptor drum 40 that is a rotating body or a developing roller 9; or heat due to the heat exchange with the fixing apparatus 60. At this time, the internal temperature of the developing apparatus 70 of the image forming device 38 may also rise, and the toner inside the developing apparatus 70 may melt and fix, and the apparatus may possibly stop or break.

For this reason, the internal temperature of the developing apparatus 70 needs to be kept below the melting point of the toner. According to the present embodiment, the image forming apparatus is provided with a liquid cooling apparatus in which a heat receiving unit (a cooling jacket) containing a cooling liquid flowing therein is made to be in contact with the side of the developing apparatus 70 so that an increase in internal temperature of the developing apparatus 70 is reduced.

Figure 3:
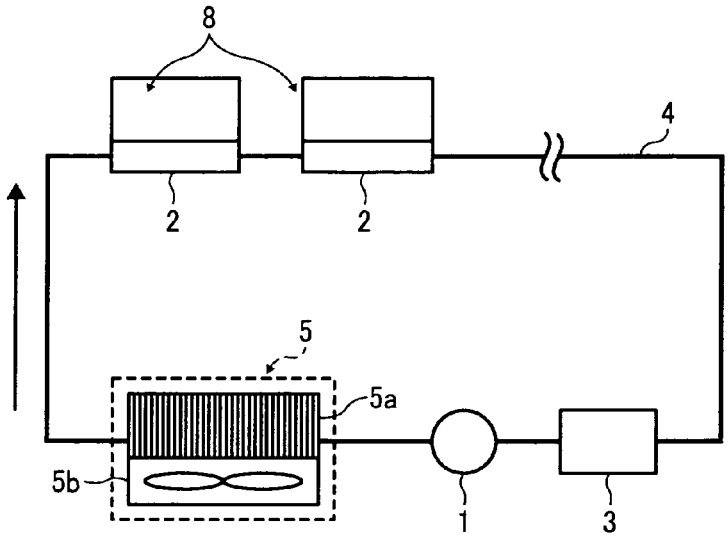
FIG. 3 is a schematic view of a liquid cooling apparatus based on a liquid cooling system.

FIG. 3 is a schematic view illustrating an example of a liquid cooling apparatus 10. As illustrated in FIG. 3, the liquid cooling apparatus 10 includes: a tube 4 that contains the cooling liquid therein; a heat radiating unit 5; a heat receiving unit 2; a pump 1; and a tank 3. The heat radiating unit 5 includes a radiator 5*a*, and a cooling fan 5*b* that constitute the tube 4. The heat radiating unit 5 discharges the heat inside the tube 4 into the atmosphere. The heat receiving unit 2 is disposed in contact with a temperature rising portion 8 so that the cooling liquid deprives the heat of the temperature rising portion 8. The pump 1 is a conveying unit for circulating the cooling liquid inside the tube 4 between the heat radiating unit 5 and the heat receiving unit 2. The tank 3 is used to inject the cooling liquid into the tube 4. The cooling liquid in the tube 4 that has been cooled when the heat thereof is discharged into the atmosphere by the heat radiating unit 5 flows into the heat receiving unit 2 and deprives heat of the temperature rising portion 8, so that the temperature rising portion 8 is cooled down. The cooling liquid in the tube 4 that has been heated in the heat receiving unit 2 is sent into the radiator 5*a* of the heat radiating unit 5 by the pump 1. Heat of the cooling liquid is discharged into the atmosphere by the cooling fan 5*b*, so that the cooling liquid is cooled down. The cooled liquid in the tube 4 is sent again toward the heat receiving unit 2.

The pump 1 is a self-priming pump and generates the pulsation, which is an intermittent pressure fluctuation, in the fed cooling liquid when the cooling liquid is sent out. The radiator 5*a* of the heat radiating unit 5 includes a complicated flow passage formed in a good heat conductive member and a fin connected with the flow passage and formed of a good heat conductive member. The radiator 5*a* decreases the temperature of the cooling liquid flowing along the flow passage by cooling down the flow passage and the fin through forced-convection heat transfer using the cooling fan 5*b*. If water is used as the cooling liquid, the specific heat capacity at a constant volume is 3000 times or more that of the air, and a large quantity of heat can be conveyed by a small quantity of flow. Therefore, effective cooling can be performed compared to forced air-cooling.

Configuration Example 1

Figure 1A:
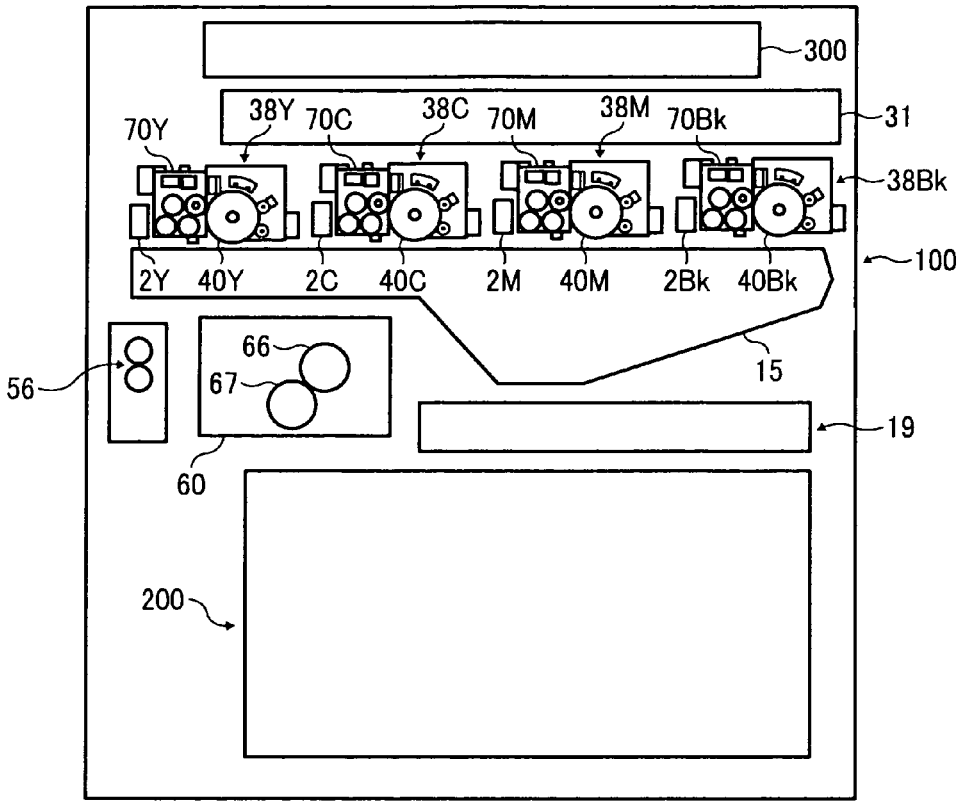
FIG. 1A is a schematic front view of an image forming apparatus.
Figure 1B:
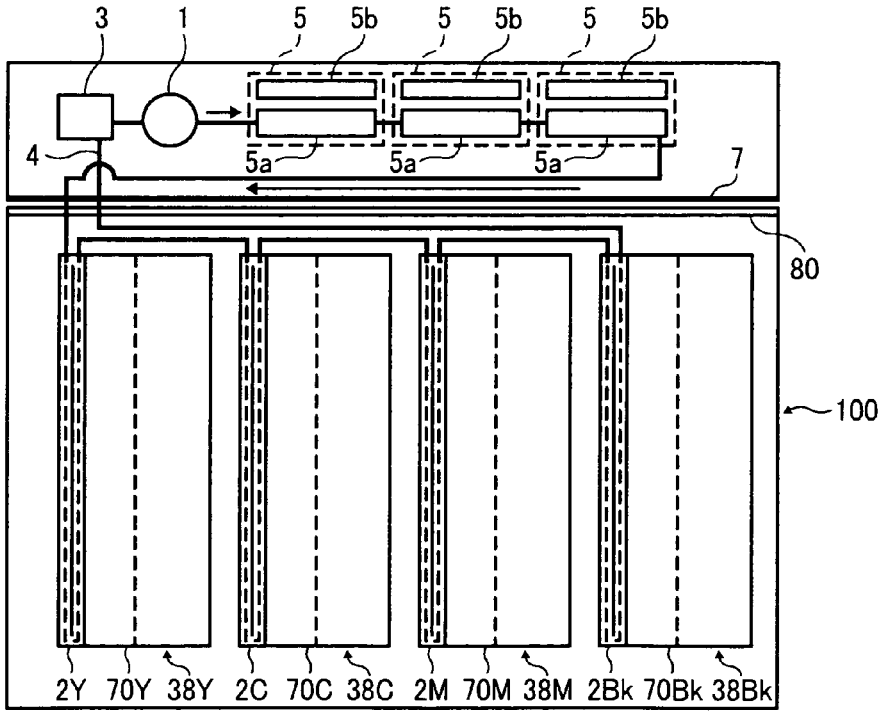
FIG. 1B is a schematic top view illustrating an image forming unit and a liquid cooling apparatus of an image forming apparatus.

FIG. 1A is a schematic front view of the image forming apparatus, and a FIG. 1B is a schematic top view illustrating the image forming device 38 and the liquid cooling apparatus 10 of the image forming apparatus. Heat receiving units 2Y, 2C, 2M, and 2Bk are disposed in close contact with the four developing apparatuses 70Y, respectively. The heat receiving units 2Y, 2C, 2M, and 2Bk, the tank 3, the pump 1, and the radiator 5*a* are connected by the tube 4 in a ring form. The cooling liquid circulates in an arrow direction illustrated in FIG. 1B. That is, the cooling liquid circulates in the order of the pump 1, the radiator 5*a*, the heat receiving unit 2, and the tank 3 starting with the pump 1.

Figure 4A:
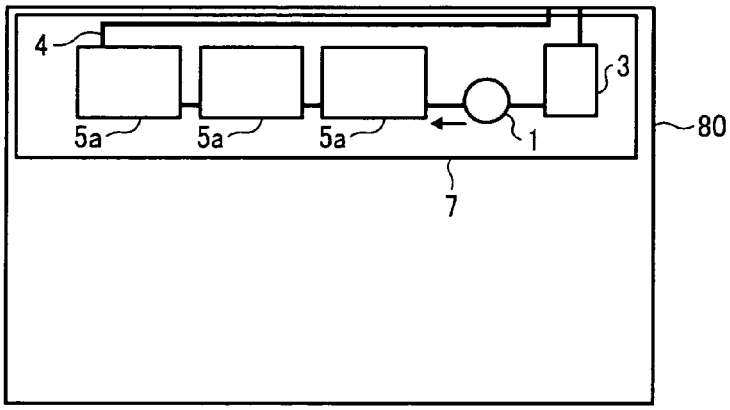
FIG. 4A is a basic structural view of a liquid cooling apparatus viewed from the rear side of the apparatus.

Except for the heat receiving unit 2, the main components of the liquid cooling apparatus 10 such as the pump 1, the tank 3, the radiator 5*a* of the heat radiating unit 5, and the cooling fan 5*b* (not shown) are fixed onto the same plane of a sheet metal 7 as illustrated in FIG. 4A. The sheet metal 7 is mounted to an upper external surface of a rear side plate 80 so that a surface of the sheet metal 7 at an opposite side to the side having the pump 1 fixed thereto can face an external surface of the rear side plate 80 of the image forming unit 100. That is, the pump 1, the tank 3, and the radiator 5*a* that are the components of the liquid cooling apparatus 10 are disposed on the external surface of the rear side plate 80 at the rear side of the image forming apparatus.

By disposing the pump 1, the tank 3, and the radiator 5*a* on the external surface of the rear side plate 80 with the sheet metal 7 interposed therebetween as described above, the installation portion of the pump 1, the tank 3, and the radiator 5*a* is separated from the inside of the image forming unit 100 by the rear side plate 80 and the sheet metal 7. For this reason, even if the liquid leaks from the pump 1, the tank 3, or the radiator 5*a*, the leaked cooling liquid is prevented from flowing into the image forming unit 100. Particularly, even if the liquid leaks from the tank 3 having the largest quantity of stored cooling liquid, the leaked cooling liquid can be prevented from flowing into the image forming unit 100, and thus it is effective.

Figure 4B:
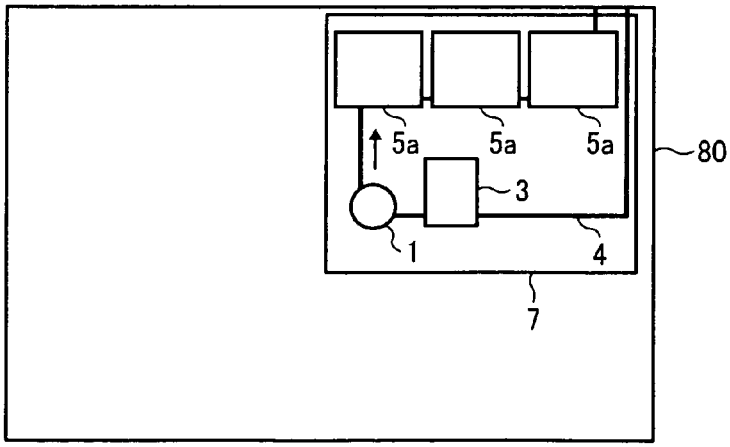
FIG. 4B is a basic structural view of a liquid cooling apparatus viewed from the rear side of the apparatus.

Further, as illustrated in FIG. 4B, the sheet metal 7 on which the pump 1, the tank 3, the radiator 5*a* of the heat radiating unit 5, and the cooling fan 5*b* (not shown) are disposed may be mounted on one side of the upper external surface of the rear side plate 80 (any one side of the left and right). The pump 1, the tank 3, and the radiator 5*a* as the components of the liquid cooling apparatus 10 may be disposed on one side of the upper external surface of the rear side plate 80 at the rear side of the image forming apparatus. Even in this case, the same effects as described above are obtained. Further, as illustrated in FIG. 4B, the tank 3 is mounted at a position as low as possible in the sheet metal 7. In this case, even if the liquid leaks from the tank 3, a range in which the cooling liquid splashes becomes as lower as a position of the tank 3 and is restricted to a lower portion of the image forming apparatus. Therefore, damage to the apparatus can be reduced.

Further, since the pump 1 for circulating the cooling liquid is apart from the image forming unit 100, the vibration to be transferred to the inside of the image forming unit 100 at the time of driving of the pump 1 can be reduced. This suppresses the phenomenon that the vibration of the pump 1 is transferred to the image forming unit 100 and the image position is misaligned, that is, the bad influence on the image is suppressed.

Since the radiator 5*a* is disposed at a downstream side of the pump 1 in a cooling liquid flow direction, and the cooling liquid flows from the pump 1 to the heat receiving unit 2 through the radiator 5*a*, the pulsation of the pump 1 is reduced by the radiator 5*a* having the complicated flow passage before the cooling liquid is sent to the heat receiving unit 2. As a result, the phenomenon that the vibration caused by the pulsation of the cooling liquid conveyed by the pump 1 is transferred to the image forming unit 100 through the tube 4 or the heat receiving unit 2 so that the image position is misaligned is suppressed. That is, the influence on the image can be suppressed.

Here, unlike the present configuration example, if the radiator 5*a* is disposed at an upstream side of the pump 1 in the cooling liquid flow direction, the cooling liquid is heated by drive heat of the pump 1 (heat generated when the pump 1 is driven) while passing through the pump 1. As described above, if the cooling liquid heated by the pump 1 is sent to the heat receiving unit 2, the cooling efficiency of the heat receiving unit 2 in cooling the developing apparatus 70 deteriorates. On the contrary, by disposing the radiator 5*a* at the downstream side of the pump 1 in the cooling liquid flow direction as in the present configuration example, the cooling liquid heated by the drive heat of the pump 1 is cooled down by the radiator 5*a* and thereafter sent to the heat receiving unit 2. As a result, the cooling efficiency for the developing apparatus 70 by the heat receiving unit can be prevented from deteriorating.

Figure 5A:
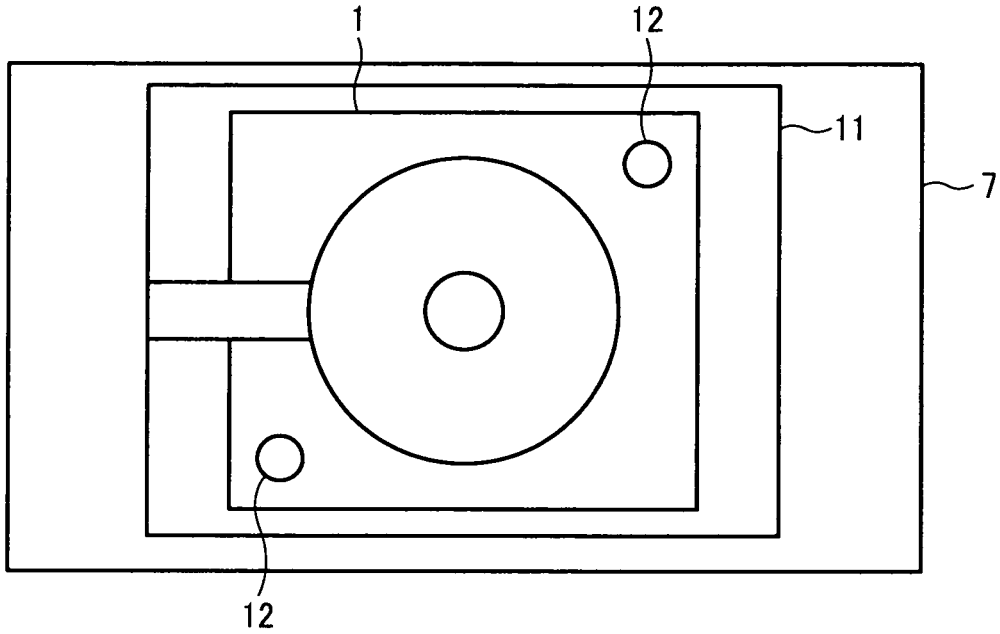
FIGS. 5A and 5B are schematic views illustrating a case in which a pump is mounted to a sheet metal with an elastic body interposed therebetween.
Figure 5B:
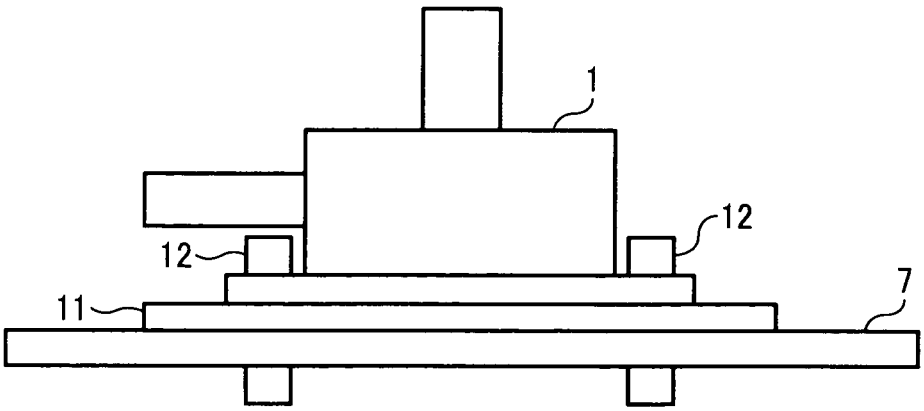

Further, as illustrated in FIGS. 5A and 5B, the pump 1 may be fixed to the sheet metal 7 by a screw 12 with an elastic body 11 (e.g., a vibration-proofing material) interposed between the sheet metal 7 and the pump 1. Thus, the vibration of the pump 1 to be transferred to the sheet metal 7 is attenuated, and so the vibration of the pump 1 to be transferred to the image forming unit 100 is further reduced. The phenomenon that the vibration of the pump 1 is transferred to the image forming unit 100 so that the image position is misaligned is further suppressed. That is, the bad influence on the image can be further suppressed.

The elastic body 11 interposed between the sheet metal 7 and the pump 1 may be made of a material such as rubber and sponge which can mitigate the vibration to be transferred from the pump 1 to the image forming unit 100. Since the amplitude of the vibration generated by the pump 1 depends on the performance of the pump 1, the size or thickness of the elastic body 11 may be preferably changed depending on the performance of the pump 1 so that the vibration is transferred as little as possible to the sheet metal 7 or the rear side plate 80.

Configuration Example 2

Figure 6:
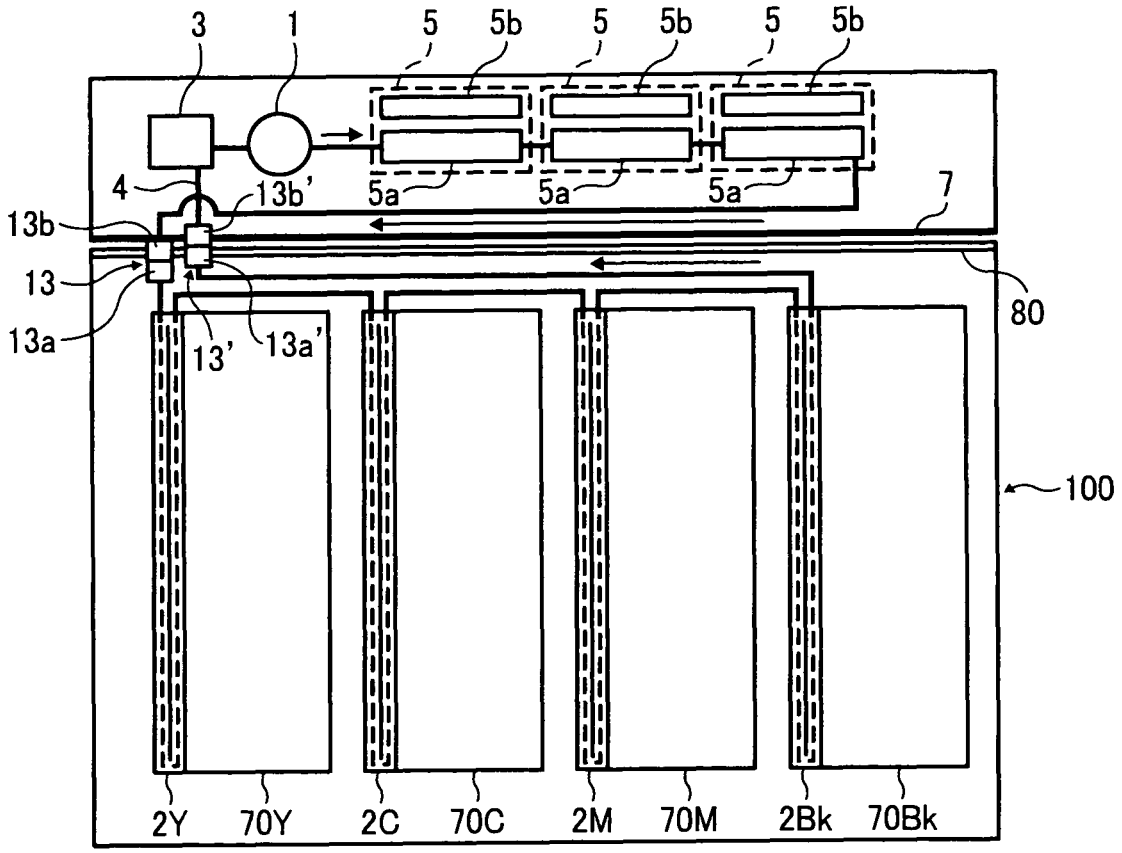
FIG. 6 is a schematic view illustrating a basic structure, a mounting position, and a circulation passage of a liquid cooling apparatus viewed from the top side of the apparatus.

As illustrated in FIG. 6, according to the present configuration example, the tube 4 at the side of the heat receiving unit 2 disposed in the image forming unit 100 and the tube 4 at the side of the pump 1, the tank 3, and the radiator 5*a* can be connected with or disconnected from each other by a coupler 13 with a valve and a coupler 13' with a valve (for example, couplers made by Nitto Kohki Co., Ltd.). When a plug 13*a* is connected with a socket 13*b*, the valve of the coupler 13 is opened so that the flow passage inside the coupler 13 is opened. When the plug 13*a* is disconnected from the socket 13*b*, the valve of the coupler 13 is closed, so that the flow passage inside the coupler 13 is closed. Similarly, when a plug 13*a*' is connected with a socket 13*b*', the valve of the coupler 13' is opened so that the flow passage inside the coupler 13' is opened. When the plug 13*a*' is disconnected from the socket 13*b*', the valve of the coupler 13' is closed, so that the flow passage inside the coupler 13' is closed.

According to the present configuration, the plug 13*a* of the coupler 13 mounted to the tube 4 disposed at the downstream side of the heat receiving unit 2 in the cooling liquid flow direction is connected with the socket 13*b* of the coupler 13 mounted to the tube 4 disposed at the upstream side of the tank 3 in the cooling liquid flow direction. When the plug 13*a* and the socket 13*b* are connected, the valve of the coupler 13 is opened. The flow passage inside the coupler 13 is opened, so that the cooling liquid flows from the heat receiving unit 2 to the tank 3. Further, the plug 13*a*' of the coupler 13' mounted to the tube 4 disposed at the downstream side of the radiator 5*a* in the cooling liquid flow direction is connected with the socket 13*b*' of the coupler 13' mounted to the tube 4 disposed at the upstream side of the heat receiving unit 2 in the cooling liquid flow direction. When the plug 13*a*' and the socket 13*b*' are connected, the valve of the coupler 13' is opened. The flow passage inside the coupler 13' is opened, so that the cooling liquid flows from the radiator 5*a* to the heat receiving unit 2.

Meanwhile, when the plug 13*a* and the socket 13*b* of the coupler 13 are disconnected, the plug 13*a*' and the socket 13*b*' of the coupler 13' are disconnected. The valves of the coupler 13 and the coupler 13' are closed, so that the flow passage inside the coupler 13 and the flow passage inside the coupler 13' are closed. Thus, even if the circulation passage in which the cooling liquid flows in the liquid cooling apparatus 10 is divided by the coupler 13 and the coupler 13', the cooling liquid is prevented from leaking to the outside.

Therefore, the circulation passage in which the cooling liquid flows can be divided between the side of the heat receiving unit 2 and the side of the pump 1, the tank 3, and the radiator 5*a* without leakage of the cooling liquid. Therefore, since the coupler 13 and the coupler 13' are provided, leaking of the cooling liquid is suppressed. Further, as compared to the case without employing the structure that can divide the circulation passage, workability of component replacement or maintenance on broken components in the liquid cooling apparatus 10 of the present configuration may be improved.

Configuration Example 3

Figure 7A:
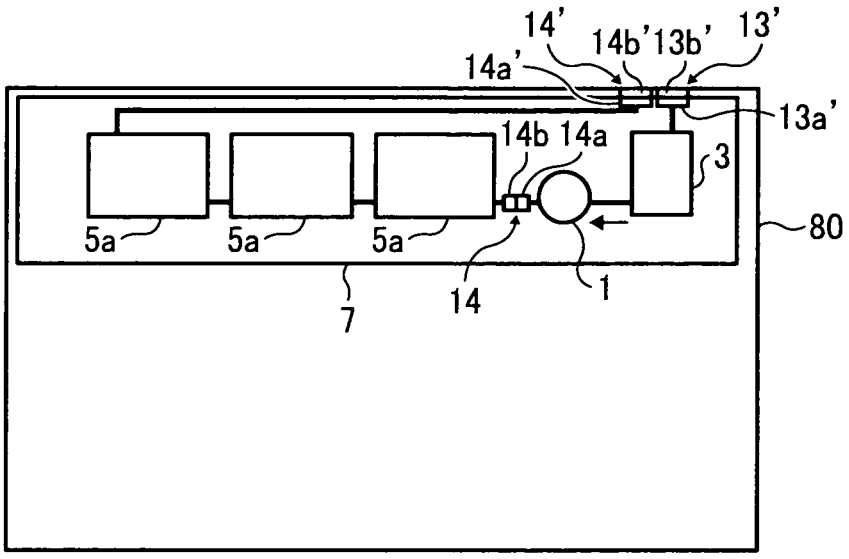
FIG. 7A is a basic structure view of a liquid cooling apparatus viewed from the rear side of the apparatus.
Figure 7B:
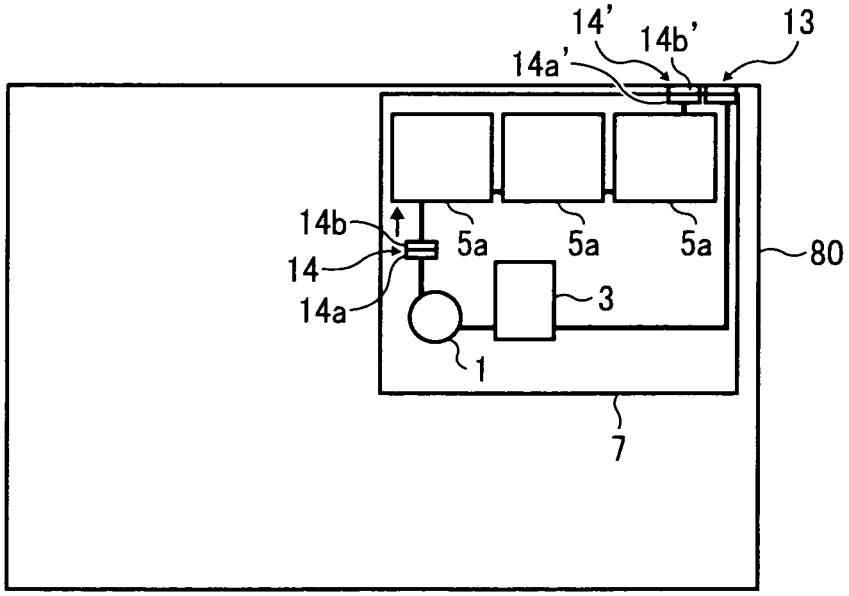
FIG. 7B is a basic structure view of a liquid cooling apparatus viewed from the rear side of the apparatus.

FIGS. 7A and 7B illustrate a case of providing a coupler 14 with a valve and a coupler 14' with a valve (for example, couplers made by Nitto Kohki Co., Ltd.) at the downstream side and at the upstream side of the radiator 5*a* in the cooling liquid flow direction, respectively, in addition to the structure illustrated in the configuration example 2. The cooling fan 5*b* of the heat radiating unit 5 is omitted so that the radiator 5*a* may be clearly viewed.

In the state in which the radiator 5*a* is mounted to the image forming unit 100, a plug 14*a* of the coupler 14 mounted to the tube 4 disposed at the downstream side of the pump 1 in the cooling liquid flow direction is connected with a socket 14*b* of the coupler 14 mounted to the tube 4 disposed at the upstream side of the radiator 5*a* in the cooling liquid flow direction. When the plug 14*a* and the socket 14*b* are connected, the flow passage inside the coupler 14 is opened, so that the cooling liquid flows from the pump 1 to the radiator 5*a*. Further, a plug 14*a*' of the coupler 14' mounted to the tube 4 disposed at the downstream side of the radiator 5*a* in the cooling liquid flow direction is connected with a socket 14*b*' of the coupler 14' mounted to the tube 4 disposed at the upstream side of the heat receiving unit 2 in the cooling liquid flow direction. When the plug 14*a*' and the socket 14*b*' are connected, the flow passage inside the coupler 14' is opened, so that the cooling liquid flows from the radiator 5*a* to the heat receiving unit 2.

When removing the radiator 5*a* from the image forming unit 100, the plug 14*a* and the socket 14*b* of the coupler 14 are disconnected, and the plug 14*a*' and the socket 14*b*' of the coupler 14' are disconnected. Thus the flow passages of the coupler 14 and the coupler 14' are closed. Therefore, the circulation passage in which the cooling liquid flows can be divided without allowing the cooling liquid to leak to the outside, and the radiator 5*a* can be removed from the image forming unit 100 in the state the radiator 5*a* is filled with the cooling liquid.

Here, when injecting the cooling liquid into the radiator 5*a*, in order to obtain the maximum cooling performance of the cooling liquid by the radiator 5*a*, the cooling liquid preferably fills the whole circulation passage inside the radiator 5*a*.

However, it is extremely difficult to fill the whole circulation passage inside the radiator 5*a* having the narrow flow passage with the cooling liquid. As a technique of filling the radiator 5*a* with the cooling liquid, there is a technique of vacuuming the air in the flow passage inside the radiator 5*a* once and then filling the flow passage inside the radiator 5*a* with the cooling liquid. The cooling liquid can fill the whole circulation passage inside the liquid cooling apparatus 10 through the vacuuming method. However, in this case, the tank 3 or other devices should be inevitably made of material that can endure the pressure difference between the vacuum and the atmospheric pressure. This increases the cost, leading to an expensive liquid cooling apparatus. For this reason, after the valve of the coupler 14 disposed at the upstream side of the radiator 5*a* in the cooling liquid flow direction and the valve of the coupler 14' disposed at the downstream side in the cooling liquid flow direction are closed, only the flow passage inside the radiator 5*a* may be filled with the cooling liquid employing the vacuuming method. Therefore, according to the present embodiment, it is possible to fill the flow passage in the radiator 5*a* with the cooling liquid, suppressing an increase in cost because the tank 3 may be made of inexpensive resin.

Further, in order to fill the other components, excluding the radiator 5*a*, of the liquid cooling apparatus 10 with the cooling liquid, for example, the tube 4 connected to the plug 14*a* has a redundant length (not illustrated). The coupler 14 and the coupler 14' have the same configuration. The plug 14*a* and the socket 14*b* of the coupler 14 are disconnected, and the plug 14*a*' and the socket 14*b*' of the coupler 14' are disconnected. The plug 14*a* of the coupler 14 is connected with the socket 14*b*' of the coupler 14' and the cooling liquid is circulated by the pump 1, so that the cooling liquid fills the other components of the liquid cooling apparatus 10. Thereafter, the plug 14*a* of the coupler 14 is disconnected from the socket 14*b*' of the coupler 14', and the plug 14*a* and the socket 14*b* of the coupler 14 are connected. The valve inside the coupler 14 is opened to open the flow passage. The plug 14*a*' and the socket 14*b*' of the coupler 14' are connected. The valve inside the coupler 14' is opened to open the flow passage. Therefore, the liquid can fill the whole circulation passage inside the liquid cooling apparatus 10. By filling the whole circulation passage inside the liquid cooling apparatus 10 with the cooling liquid as described above, the effective cooling performance may be obtained.

Further, the radiator 5*a* whose flow passage is filled with the cooling liquid may be made a replacement part. Thus, even if the radiator 5*a* is replaced, the liquid cooling apparatus 10 having the stable performance can be provided.

Configuration Example 4

Figure 8:
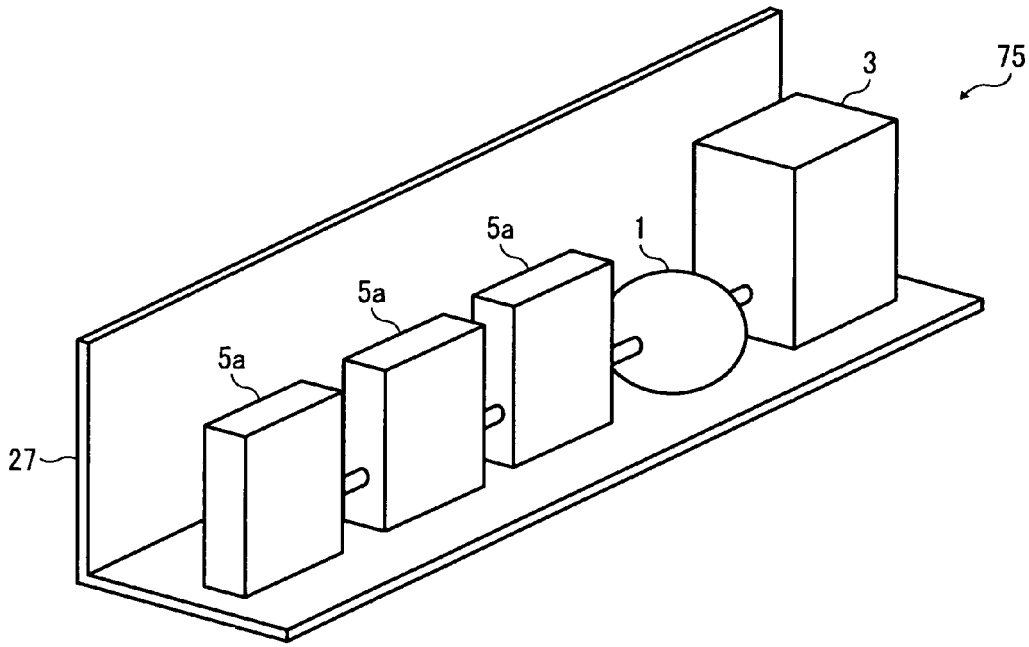
FIG. 8 is a schematic view of a unit including pump, a tank, and a radiator.

FIG. 8 is a schematic view illustrating a unit 75 in which the pump 1, the tank 3, and the radiator 5*a* are disposed and unitized on an installation surface of an L-shaped sheet metal 27. Even thought not shown, the cooling fan 5*b* of the heat radiating unit 5 is disposed on the sheet metal 27. The sheet metal 27 on which the pump 1, the tank 3, and the radiator 5*a* are disposed are attachably and detachably mounted to the rear side plate 80 of the image forming unit 100. By removing the sheet metal 27 from the rear side plate 80, the radiator 5*a*, the pump 1, and the tank 3 may be removed from the image forming unit 100 as a whole. By removing the unit 75 from the rear side plate 80 as described above, the size of the image forming apparatus is reduced as much as the unit 75 is removed, and it is easy to convey the image forming apparatus.

In order to unitize the pump 1, the tank 3, and the radiator 5*a*, as a member to which the components are mounted, a resin plate may be used instead of the sheet metal. However, since the pump 1, the tank 3, and the radiator 5*a* have heavy weights, the resin plate may be broken if the strength is insufficient. Thus, it is necessary to reinforce it, for example, by increasing the thickness of the resin plate.

Driving mechanisms of a variety of members such as the image forming device 38 disposed in the image forming unit 100 or electrical components such as a harness are disposed on the rear side plate 80 that is the rear side inside the image forming unit 100. For example, when the pump 1, the tank 3, and the radiator 5*a* are mounted on the upper external surface of the rear side plate 80 at the rear side of the image forming apparatus as illustrated in FIG. 4A, since the pump 1, the tank 3, and the radiator 5*a* can be integrally removed from the rear side plate 80 as the unit 75 for the maintenance of the driving mechanisms inside the image forming unit 100 or the maintenance of the other electrical components such as the harness, the workability of the maintenance is improved. Further, when the pump 1, the tank 3, and the radiator 5*a* are attachably and detachably mounted on the lower external surface of the rear side plate 80 integrally as the unit 75 as illustrated in FIG. 4B, the maintenance on the lower portion of the image forming apparatus can be easily performed by removing the unit 75 from the rear side plate 80.

Figure 9:
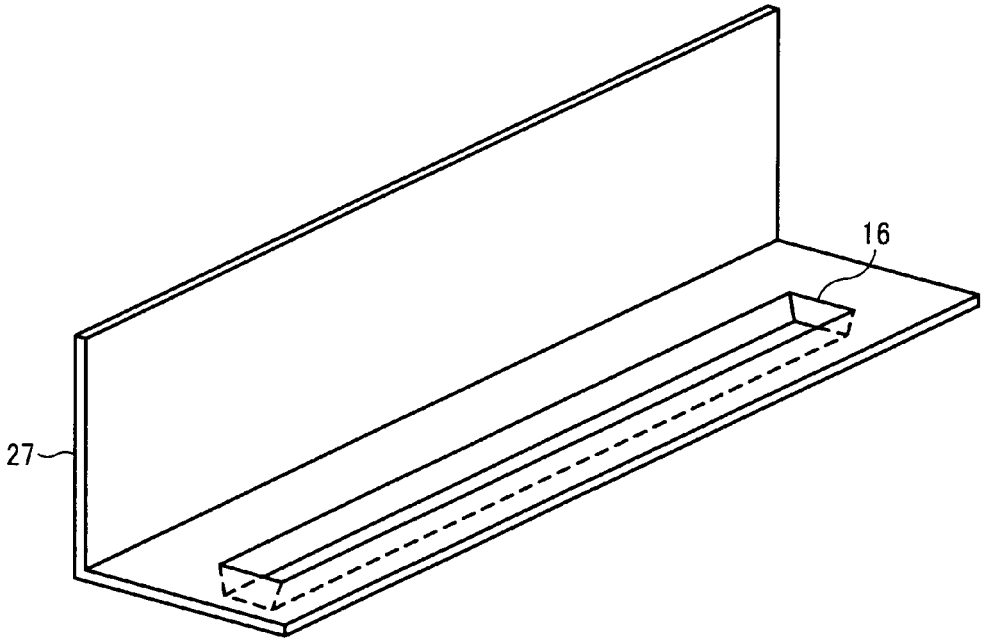
FIG. 9 is a schematic view illustrating a case in which a groove is formed in an installation surface of a sheet metal.

FIG. 9 is a schematic view illustrating a case in which a groove 16 recessed from the installation surface of the L-shaped sheet metal 27 illustrated in FIG. 8 is formed.

As illustrated in FIG. 9, the groove 16 recessed from the installation surface on which, for example, the pump 1 is disposed is formed in the sheet metal 27. If the cooling liquid leaks from the pump 1, the tank 3, or the radiator 5*a*, the cooling liquid is collected in the groove 16, so that the cooling liquid may not flow out of the unit 75.

The capacity of the groove 16 is preferably larger than the collective volume of the cooling liquid that fills the pump 1, the tank 3, and the radiator 5*a*. Thus even when a large amount of cooling liquid leaks out from the pump 1, the tank 3, and the radiator 5*a*; the leaked cooling liquid may be collected in the groove 16. Thus, the cooling liquid is prevented from leaking out of the unit 75. Of course, even when the capacity of the groove 16 is smaller than the volume of the cooling liquid that fills the pump 1, the tank 3, and the radiator 5*a*, by collecting the cooling liquid in the groove 16, the cooling liquid may be prevented from leaking out from the unit 75. Particularly, when a small amount of cooling liquid leaks from a joint portion or a crack due to degradation with time, it works effectively.

Further, a verification window through which collection of the cooling liquid in the groove 16 can be visually checked from the outside of the unit 75 may be provided. Thus, an occurrence of a liquid leakage from the pump 1, the tank 3, or the radiator 5*a* may be recognized by a user or a service person who performs the maintenance.

Figure 10:
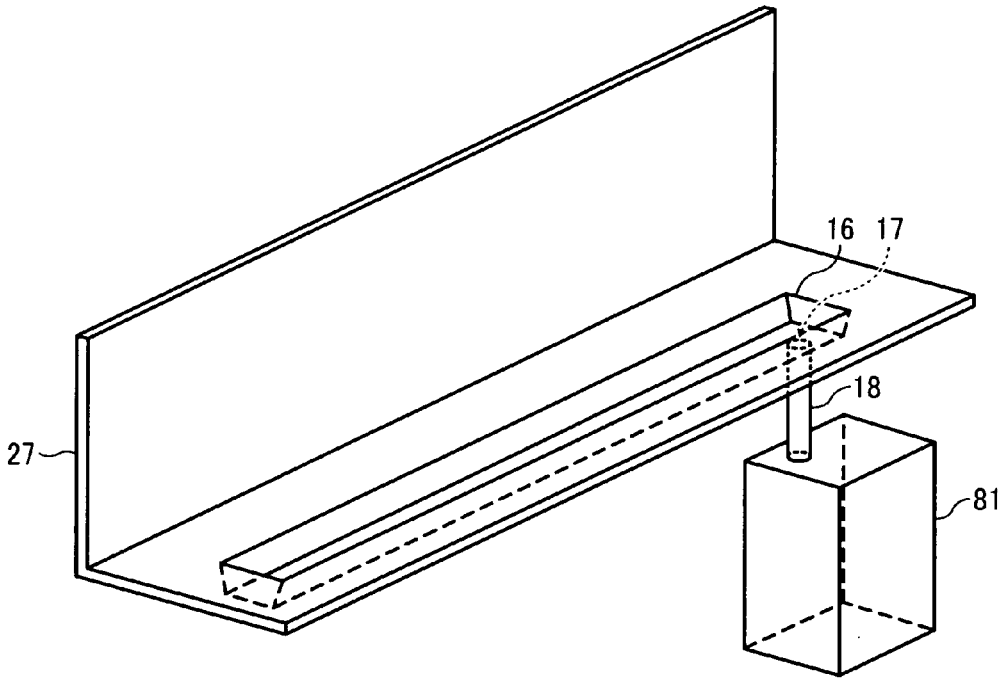
FIG. 10 is a schematic view illustrating a case in which a container for storing a cooling liquid guided from a hole formed in the lowest portion of a groove via a rubber hose is disposed below the hole.

FIG. 10 is a schematic view illustrating a structure in which a height difference is formed between one end side and the other end side of the long groove 16 of FIG. 9 to form an inclination downward from one end side to the other end side, a hole 17 is formed in the lowest portion of the groove 16, and a container 18 for storing the cooling liquid guided from the hole 17 through a rubber hose 18 is provided below the hole 17.

As illustrated in FIG. 10, by providing a container 81, when the cooling liquid leaks from the pump 1, the tank 3, or the radiator 5*a* in the unit 75, the leaked cooling liquid may be collected in the container 81 from the groove 16 through the rubber hose 18. Further, the container 81 may be transparent or semi-transparent. Thus, the volume of the cooling liquid collected in the container 81 may be visually observed. A scale mark may be formed in the container 81 so that an amount of liquid leakage can be recognized based on an amount of the cooling liquid collected in the container 81.

Further, the hole 17 formed in the lowest portion of the groove 16 may not be necessarily connected with the container 81 through the rubber hose 18. However, by connecting the hole 17 of the groove 16 with the container 81 through the rubber hose 18, the cooling liquid may be prevented from splashing out from the hole 17 to the surroundings.

Figure 11:
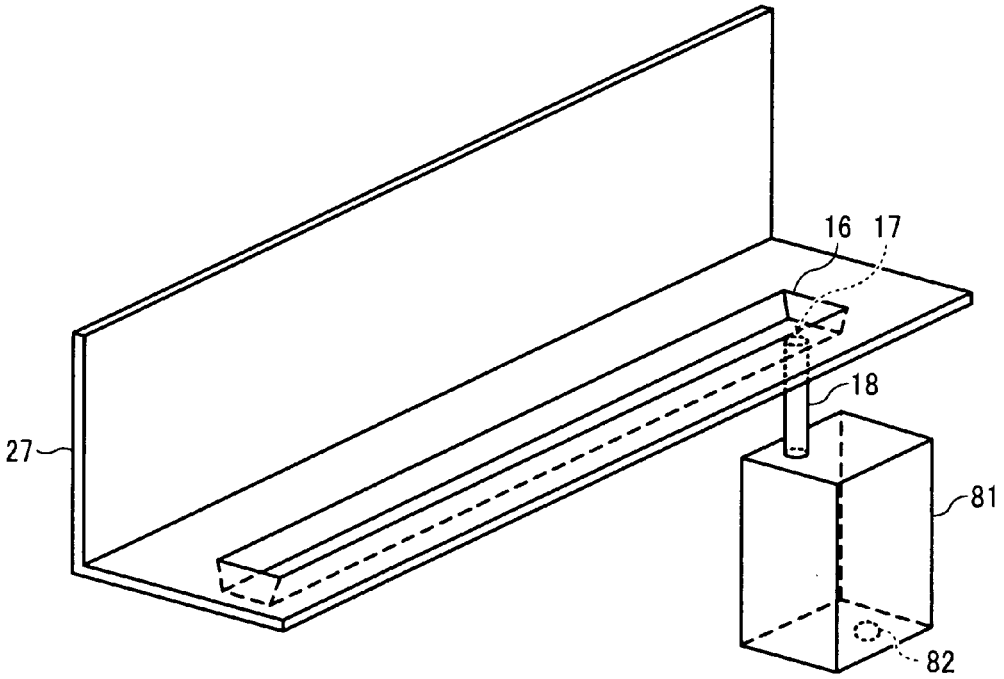
FIG. 11 is a schematic view illustrating a case in which a sensor for detecting the presence of a cooling liquid in a container is installed.

Further, as illustrate in FIG. 11, a sensor 82 (e.g., a leakage sensor) for sensing the presence of the cooling liquid in the container 81 may be provided. Thus, when the cooling liquid leaks from the pump 1, the tank 3, or the radiator 5*a* in the unit 75, by sensing the cooling liquid collected in the container through the sensor 82, the occurrence of the liquid leakage in the unit 75 can be detected. Based on the result from the detection of the leakage of the liquid, feeding of the liquid by the pump 1 to the liquid cooling apparatus 10 is stopped or an image forming operation of the image forming apparatus is stopped. Therefore, it is possible to prevent damages resulting from flowing of the cooling liquid into the electrical components, such as short-circuit that leads to firing of electric components.

The present embodiment has been explained in connection with the structure in which the heat receiving unit 2 of the liquid cooling apparatus 10 is made to be in contact with the developing apparatus 70 to cool down the developing apparatus 70. The developing apparatus 70 is a temperature rising portion in which the temperature rises due to the image forming operation. However, the temperature rising portion is not limited to the developing apparatus 70 but may be the exposure apparatus 31 or the fixing apparatus 60. In such a case, the same effects as described above may be obtained.

Figure 12:
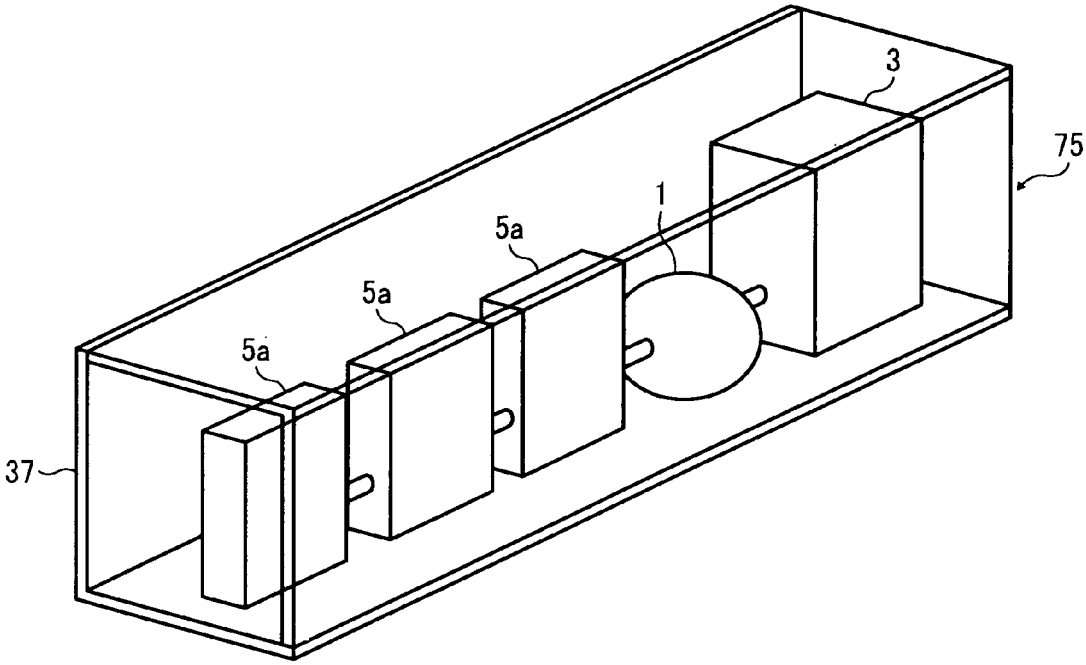
FIG. 12 is a schematic view illustrating a case in which a pump, a tank, and a radiator are installed in a box-shaped sheet metal as a unit.
Figure 13:
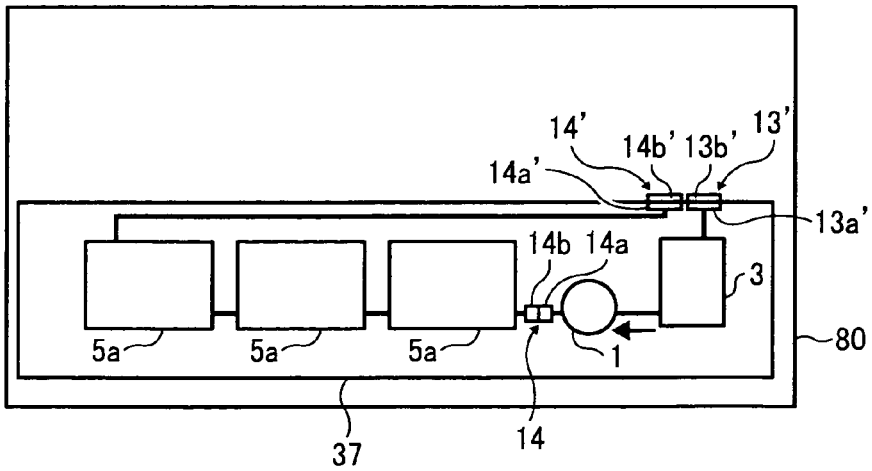
FIG. 13 is a schematic view illustrating a case in which the unit is disposed at a lower portion of the external surface of the rear plate of an apparatus body.

The pump 1, the tank 3, and the radiator 5*a* are mounted to the sheet metal of the unit 75 which is attachably and dettachably mounted to the rear side plate 80 of the image forming unit 100. However, the sheet metal does not have to be the L-shaped sheet metal 27 as illustrated in FIG. 8, instead a box-shaped sheet metal 37 may be used as illustrated in FIG. 12. By disposing the pump 1, the tank 3, and the radiator 5*a* in the box-shaped sheet metal 37, when the liquid leaks, the liquid is further prevented from splashing to the outside of the unit 75. Further, as illustrated in FIG. 13, the pump 2, the tank 3, and the radiator 5*a* may be disposed in the box-shaped sheet metal 37 and integrally disposed on the lower external surface of the rear side plate 80 as the unit 75. Thus, even when the liquid splashes out from the unit 75, damages may be further reduced.

Figure 14:
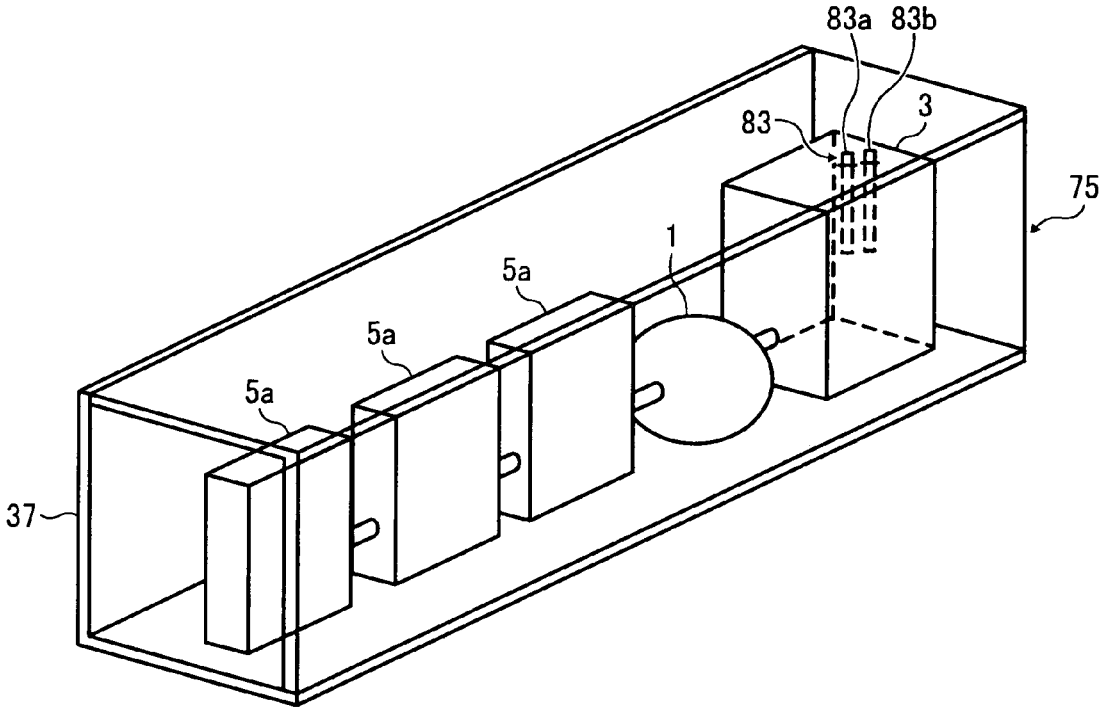
FIG. 14 is a schematic view illustrating a case in which a liquid amount detecting sensor for detecting an amount of a liquid is disposed inside a tank.

Further, as illustrated in FIG. 14, a liquid amount detecting sensor 83 for detecting an amount of liquid in the tank 3 may be installed in the tank 3. The liquid amount detecting sensor 83 disposed in the tank 3 can be used as a detecting unit for detecting not only the liquid leakage but also reduction of the liquid in the system that is attributable to time degradation. The liquid amount detecting sensor 83 may inform the user of the liquid replacement time, and may reduce the cost. According to the present embodiment, dipolar conductive units 83*a* and 83*b* as the liquid amount detecting sensor 83 are immersed in the tank 3. An electric current is flowed in the dipolar conductive units 83*a* and 83*b*, and an amount of a liquid reduced in the tank 3 can be detected based on a resistance value at that time. An amount of a liquid reduced can be indirectly examined by making the resolution fine. Meanwhile, when an amount of a liquid in the tank 3 is reduced to the extent by which the dipolar conductive units 83*a* and 83*b* are not immersed in the liquid, the resistance value becomes infinite. Thus, when detection of only the liquid leakage is desired, finer resolution is not needed.

Second Embodiment

Hereinafter, a second embodiment of an image forming apparatus of the present invention will be explained. The basic structure of the image forming apparatus according to the second embodiment is the same as the image forming apparatus according to the first embodiment, and thus description thereof will not be repeated.

Figure 15A:
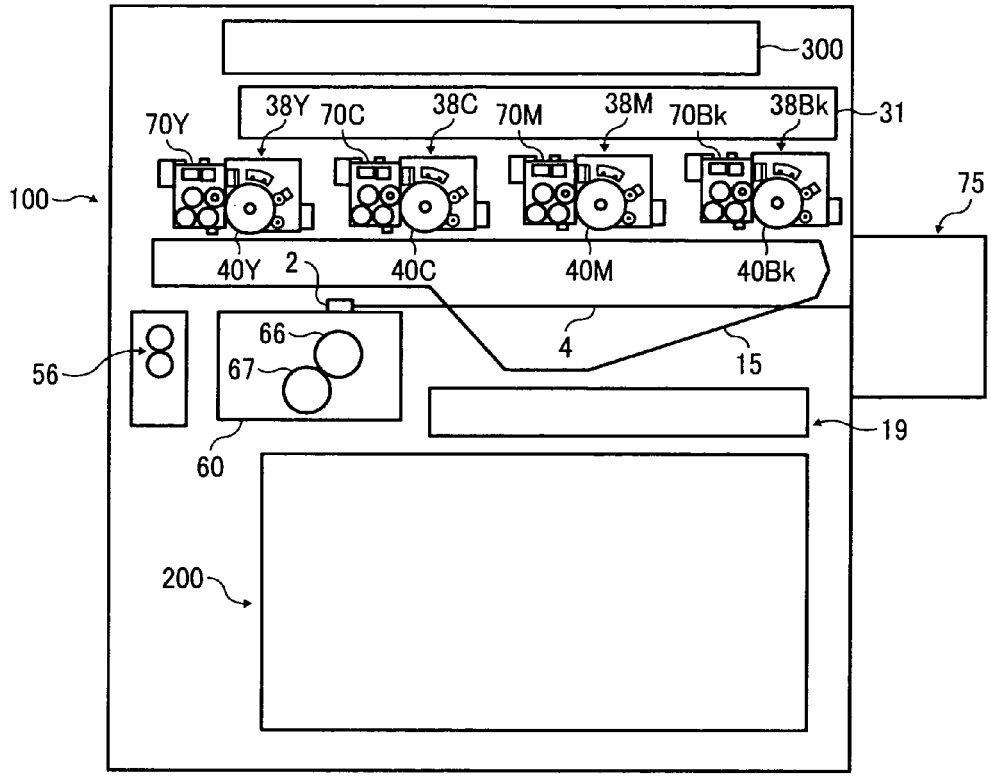
FIG. 15A is a schematic front view of an image forming apparatus according to a second embodiment.
Figure 15B:
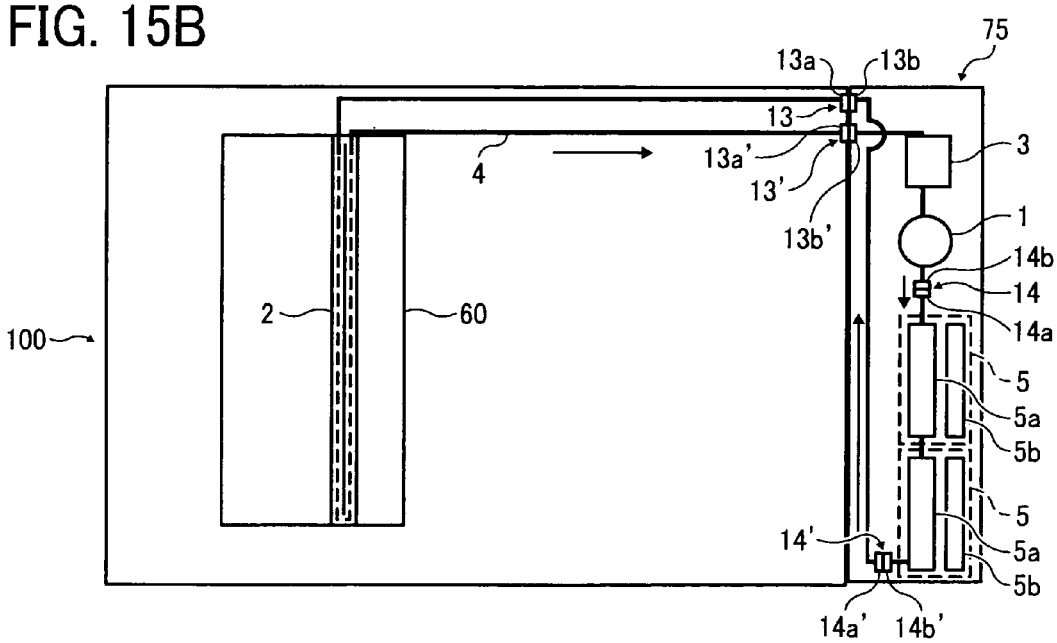
FIG. 15B is a schematic top view illustrating a fixing apparatus and a liquid cooling apparatus of an image forming apparatus.

FIG. 15A is a schematic front view illustrating an image forming apparatus, and FIG. 15B is a schematic top view illustrating a fixing apparatus 60 and a liquid cooling apparatus 10 of the image forming apparatus. According to the second embodiment, a heat receiving unit (the cooling jacket) 2 is disposed by closely attached to the fixing apparatus 60 disposed in an image forming unit 100. The heat receiving unit 2, a tank 3, a pump 1, and a radiator 5*a* are connected in a ring form through a tube 4. A cooling liquid circulates and flows in the order of the pump 1, a radiator 5*a*, the heat receiving unit 2, and the tank 3, starting from the pump 1.

As described above, the radiator 5*a* is disposed at the downstream side of the pump 1 in the cooling liquid flow direction and at the upstream side of the heat receiving unit 2 in the cooling liquid flow direction, and the cooling liquid flows from the pump 1 to the heat receiving unit 2 through the radiator 5*a*. Therefore, while the cooling liquid flows in the complicated flow passage in the radiator 5*a*, the pulsation generated in the cooling liquid by the pump 1 is reduced before the cooling liquid is sent to the heat receiving unit 2. This reduces the vibration that is generated in the heat receiving unit 2 due to the pulsation of the cooling liquid. Therefore, it is possible to reduce the vibration to be transferred from the heat receiving unit 2 to the image forming unit 100 through the fixing apparatus 60 that is a temperature increasing portion in which the temperature increases due to an image forming operation. Further, the phenomenon that the vibration has a bad influence on the image forming operation and thus good image formation cannot be performed can be prevented.

In the image forming apparatus of the present embodiment, as illustrated in FIGS. 15A and 15B, the unit 75 that includes the pump 1, the tank 3, and the radiator 5*a* of the liquid cooling apparatus 10 is disposed on the external side of the casing of the image forming unit 100. By disposing the pump 1, the tank 3, and the radiator 5*a* on the external side of the casing of the image forming unit 100 as described above, the installation portion of the pump 1, the tank 3, and the radiator 5*a* is separated from the inside of the image forming unit 100 by the chassis. Thus, even if the liquid leaks from the pump 1, the tank 3, or the radiator 5*a*, the leaked cooling liquid is prevented from flowing into the image forming unit 100. Particularly, even if the liquid leaks from the tank 3 having the largest quantity of stored cooling liquid, the leaked cooling liquid can be prevented from flowing into the image forming unit 100, and thus it is effective.

Further, since the pump 1 for circulating the cooling liquid is apart from the image forming unit 100, the vibration to be transferred to the inside of the image forming unit 100 at the time of driving of the pump 1 can be reduced. The phenomenon that the vibration of the pump 1 is transferred to the image forming unit 100 and the image position is misaligned is reduced. That is, the bad influence on the image is reduced.

In the case of employing the structure in which the pump 1 is disposed in the unit 75 with the elastic body interposed therebetween, the vibration of the pump 1 to be transferred to the chassis of the unit 75 is attenuated by the elastic body 11, and the vibration of the pump 1 to be transferred to the image forming unit 100 is further reduced. Therefore, the phenomenon that the vibration of the pump 1 is transferred to the image forming unit 100 and the image position is misaligned is further suppressed. That is, the bad influence on the image is further suppressed.

According to the second embodiment, similarly to the first embodiment, the tube 4 at the side of the heat receiving unit 2 disposed in the image forming unit 100 and the tube 4 at the side of the pump 1, the tank 3, and the radiator 5*a* can be connected with or disconnected from each other by a coupler 13 with a valve and a coupler 13' with a valve (for example, couplers made by Nitto Kohki Co., Ltd.). When a plug 13*a* is connected with a socket 13*b*, the valve of the coupler 13 is opened, so that a flow passage inside the coupler 13 is opened. When the plug 13*a* is disconnected from the socket 13*b*, the valve of the coupler 13 is closed, so that the flow passage inside the coupler 13 is closed. Similarly, when a plug 13*a'* is connected with a socket 13*b'*, the valve of the coupler 13' is opened, so that the flow passage inside the coupler 13' is opened. When the plug 13*a'* is disconnected from the socket 13*b'*, the valve of the coupler 13' is closed, so that the flow passage inside the coupler 13' is closed.

According to the second embodiment, the plug 13*a* of the coupler 13 mounted to the tube 4 disposed at the downstream side of the heat receiving unit 2 in the cooling liquid flow direction is connected with the socket 13*b* of the coupler 13 mounted to the tube 4 disposed at the upstream side of the tank 3 in the cooling liquid flow direction. When the plug 13*a* and the socket 13*b* are connected, the valve of the coupler 13 is opened. The flow passage inside the coupler 13 is opened, so that the cooling liquid flows from the heat receiving unit 2 to the tank 3. Further, the plug 13*a'* of the coupler 13' mounted to the tube 4 disposed at the downstream side of the radiator 5*a* in the cooling liquid flow direction is connected with the socket 13*b'* of the coupler 13' mounted to the tube 4 disposed at the upstream side of the heat receiving unit 2 in the cooling liquid flow direction. When the plug 13*a'* and the socket 13*b'* are connected, the valve of the coupler 13' is opened. The flow passage inside the coupler 13' is opened, so that the cooling liquid flows from the radiator 5*a* to the heat receiving unit 2.

Meanwhile, as the plug 13*a* and the socket 13*b* of the coupler 13 are disconnected, and the plug 13*a'* and the socket 13*b'* of the coupler 13' are disconnected; the valves of the coupler 13 and the coupler 13' are closed, so that the flow passage inside the coupler 13 and the flow passage inside the coupler 13' are closed. Thus, even if the circulation passage in which the cooling liquid flows in the liquid cooling apparatus 10 is divided by the coupler 13 and the coupler 13', the cooling liquid may not leak to the outside.

Thus, the circulation passage in which the cooling liquid flows can be divided into the side of the heat receiving unit 2; and the side of the pump 1, the tank 3, and the radiator 5*a* without leakage of the cooling liquid. Therefore, by disposing the coupler 13 and the coupler 13', a leakage of the cooling liquid is prevented. Further as compared with the case without employing the structure in which the circulation passage can be divided, workability of component replacement or maintenance of broken components in the liquid cooling apparatus 10 can be improved.

According to the second embodiment, the unit 75 is so arranged to be attached to or detached from the chassis of the image forming unit 100, and by dividing the circulation passage in which the cooling liquid circulates in the liquid cooling apparatus 10 by the coupler 13 and the coupler 13', the unit 75 can be removed from the chassis of the image forming unit 100. By removing the unit 75 from the rear side plate 80 as described above, the size of the image forming apparatus is reduced as much as the unit 75 is removed, and it is easy to convey the image forming apparatus.

According to the second embodiment, a coupler 14 and a coupler 14' (for example, couplers made by Nitto Kohki Co., Ltd.) are disposed at the upstream side and at the downstream side of the radiator 5*a* in the cooling liquid flow direction, respectively. The coupler 14 and the coupler 14' having the same structure as the coupler 13 and the coupler 13' are used.

In the state the radiator 5*a* is mounted to the image forming unit 100, a plug 14*a* of the coupler 14 mounted to the tube 4 disposed at the downstream side of the pump 1 in the cooling liquid flow direction is connected with a socket 14*b* of the coupler 14 mounted to the tube 4 disposed at the upstream side of the radiator 5*a* in the cooling liquid flow direction. When the plug 14*a* and the socket 14*b* are connected, the flow passage inside the coupler 14 is opened, so that the cooling liquid flows from the pump 1 to the radiator 5*a*. Further, a plug 14*a'* of the coupler 14' mounted to the tube 4 disposed at the downstream side of the radiator 5*a* in the cooling liquid flow direction is connected with a socket 14*b'* of the coupler 14' mounted to the tube 4 disposed at the upstream side of the heat receiving unit 2 in the cooling liquid flow direction. When the plug 14*a'* and the socket 14*b'* are connected, the flow passage inside the coupler 14' is opened, so that the cooling liquid flows from the radiator 5*a* to the heat receiving unit 2.

In order to remove the radiator 5*a* from the image forming unit 100, the plug 14*a* and the socket 14*b* of the coupler 14 are disconnected, and the plug 14*a'* and the socket 14*b'* of the coupler 14' are disconnected. Thus the flow passages of the coupler 14 and the coupler 14' are closed. Therefore, the circulation passage in which the cooling liquid flows can be divided without allowing the cooling liquid to leak to the outside, and the radiator 5*a* can be removed from the image forming unit 100 in the state the radiator 5*a* is filled with the cooling liquid. Further, the radiator 5*a* whose flow passage is filled with the cooling liquid can be made a replacement part. Even if replacement of the radiator 5*a* is performed, the liquid cooling apparatus having the stable performance can be provided.

According to the image forming apparatus of the second embodiment, as described in the first embodiment, the pump 1, the tank 3, and the radiator 5*a* are disposed on the installation surface of the L-shaped sheet member of the unit 75. A groove that is recessed from the installation surface is formed in the installation surface of the sheet metal in which, for example, the pump 1 is disposed. If the cooling liquid leaks from the pump 1, the tank 3, or the radiator 5*a*, the cooling liquid is collected in the groove portion, and thus the cooling liquid may not flow out from the unit 75 to the outside.

Further, a hole is formed in the bottom surface of the groove, and the container 81 for storing the cooling liquid guided from the hole through the rubber hose is disposed below the hole. When the cooling liquid leaks from the pump 1, the tank 3, or the radiator 5*a* in the unit 75, the leaked cooling liquid may be collected in the container from the groove through the rubber hose. Further, the container may be transparent or semi-transparent. Thus, the volume of the cooling liquid collected in the container may be visually observed. The scale mark may be given to the container. In this case, an amount of liquid leakage can be recognized based on an amount of the cooling liquid collected in the container.

The second embodiment has been explained in connection with the structure in which the fixing apparatus 60 is cooled down by the heat receiving unit 2 of the liquid cooling apparatus 10. The heat receiving unit 2 is in contact with the fixing apparatus 60 that is the temperature rising portion in which the temperature rises due to the image forming operation. However, the temperature rising portion is not limited to the fixing apparatus 60 but may be an exposure apparatus 31 or a developing apparatus 70, and even in such cases, the same effects as described above may be obtained.

According to each of the embodiments 1 and 2, the image forming apparatus includes: the image forming unit 100 for forming the image; and the liquid cooling apparatus 10 as the liquid cooling unit. The liquid cooling apparatus 10 includes: the heat receiving unit 2 disposed in contact with the temperature increasing portion inside the image forming unit in which the temperature rises due to the image forming operation of the image forming unit 100; the radiator 5*a* as the heat radiating unit for radiating heat of the cooling liquid; the tube 4 as a pipe for allowing the cooling liquid to circulate between the heat receiving unit and the radiator 5*a*; and the pump 1 as the conveying unit for conveying the cooling liquid inside the tube 4. The radiator 5*a* is disposed at the downstream side of the pump 1 in the cooling liquid flow direction and at the upstream side of the heat receiving unit 2 in the cooling liquid flow direction. Since the radiator 5*a* is disposed at the downstream side of the pump 1 in the cooling liquid flow direction, the cooling liquid flows from the pump 1 to the heat receiving unit 2 through the radiator 5*a*. The pulsation of the pump 1 is attenuated by the radiator 5*a* having the complicated flow passage before the cooling liquid is sent to the heat receiving unit 2. This can prevent the phenomenon that the vibration generated by the pulsation of the cooling liquid conveyed by the pump 1 is transferred to the image forming unit 100 and has the bad influence on the image forming operation, which obstructs formation of a good image. Further, since the radiator 5*a* is disposed at the downstream side of the pump 1 in the cooling liquid flow direction, the cooling liquid heated by the drive heat of the pump 1 is cooled down before it is sent to the heat receiving unit 2. Thus, it is possible to prevent deterioration of the cooling efficiency of the developing apparatus 70 by the heat receiving unit 2.

Further, according to the first embodiment, the liquid cooling apparatus 10 has the tank 3 as a storage tank for storing the cooling liquid. Furthermore, the pump 1, the tank 3, and the radiator 5*a* are disposed at the farther rear side of the image forming apparatus body farther than the rear side plate 80 of the chassis of the image forming unit. Even if the cooling liquid leaks from the pump 1, the tank 3, or the radiator 5*a*, the cooling liquid is prevented from flowing into the image forming unit 100. Further, since the pump 1 is apart from the image forming unit 100, the vibration to be transferred to the inside of the image forming unit 100 at the time of driving of the pump 1 can be reduced. Further, the phenomenon that the vibration of the pump 1 is transferred to the image forming unit 100 and the image position is misaligned is suppressed. That is, the bad influence on the image is reduced.

Further, according to the second embodiment, the liquid cooling apparatus 10 has the tank 3 as the storage tank for storing the cooling liquid. Furthermore, the pump 1, the tank 3, and the radiator 5*a* are disposed at the outside of the casing of the image forming unit 100. Even if the cooling liquid leaks from the pump 1, the tank 3, or the radiator 5*a*, the cooling liquid is prevented from flowing into the image forming unit 100. Further, since the pump 1 is apart from the image forming unit 100, the vibration to be transferred to the inside of the image forming unit 100 at the time of driving of the pump 1 can be reduced. Further, the phenomenon that the vibration of the pump 1 is transferred to the image forming unit 100 and so the image position is misaligned is suppressed. That is, the bad influence on the image is reduced.

According to the embodiments 1 and 2, the coupler 13 and the coupler 13' as coupling members for connecting and disconnecting the tube 4 to and from the heat receiving unit 2 and the tube 4 to and from the unit 75 having the radiator 5*a*, the pump 1, and the tank 3 are provided. The portions of the liquid cooling apparatus 10 excluding the heat receiving unit 2 can be separated by the coupler 13 and the coupler 13'. This allows easy maintenance and inspection on the image forming unit 100 or the components of the liquid cooling apparatus 10 excluding the heat receiving unit 2.

According to each of the embodiments 1 and 2, the liquid cooling apparatus 10 includes: the socket 14*b* as a first coupling member disposed at the upstream side of the radiator 5*a* in the cooling liquid flow direction; the plug 14*a* as a second coupling member that is disposed in the tube 4 at the upstream side of the radiator 5*a* in the cooling liquid flow direction and connected with and disconnected from the socket 14*b*; the plug 14*a'* as a third coupling member disposed at the downstream side of the radiator 5*a* in the cooling liquid flow direction; and the socket 14*b'* as a fourth coupling member that is disposed in the tube 4 at the downstream side of the radiator 5*a* in the cooling liquid flow direction and connected with and disconnected from the plug 14*a'*. By closing the valve of the coupler 14 disposed at the upstream side of the radiator 5*a* in the cooling liquid flow direction and the valve of the coupler 14' disposed at the downstream side in the cooling liquid flow direction and closing the flow passage inside the coupler 14 and the flow passage inside the coupler 14', only the flow passage inside the radiator 5*a* may be filled with the cooling liquid in the vacuum state. Further, since the radiator 5*a* can be conveyed in the state the radiator 5*a* is filled with the cooling liquid, a maintenance unit of the state the radiator 5*a* is filled with the cooling liquid may be obtained.

According to each of the embodiments 1 and 2, the unit 75 including the radiator 5*a* of the heat radiating unit 5, the pump 1, and the tank 3 can be attached to or detached from the image forming unit 100. When the maintenance on driving mechanisms of the image forming unit 100 or the maintenance on electrical components such as a harness is performed, the unit 75 including the radiator 5*a*, the pump 1, and the tank 3 can be removed from the rear side plate 80 of the image forming unit 100 at once, and thus workability is improved.

According to each of the embodiments 1 and 2, the groove 16 is formed in the bottom surface of the sheet metal 27 as the installation portion on which the heat radiating unit 5, the pump 1, and the tank 3 are disposed as the unit 75. The cooling liquid is collected in the groove 16 portion, and thus the cooling liquid is not allowed to flow out from the inside of the unit 75 to the other portions.

According to each of the embodiments 1 and 2, the hole 17 is formed in the bottom of the groove 16, and the container 81 is provided below the hole 17. The leaked cooling liquid is collected in the container 81.

According to each of the embodiments 1 and 2, the sensor as the detecting sensor for detecting the presence of the cooling liquid in the container is provided. Thus, it is possible to detect the liquid leakage from the portions of the liquid cooling apparatus 10 excluding the heat receiving unit 2.

According to the first embodiment, the pump 1, the tank 3, and the radiator 5*a* are disposed in the box-shaped sheet metal 37 that is the box-shaped casing as the unit 75. If the liquid leakage occurs, it is possible to further prevent the liquid from escaping from the unit 75.

According to the first embodiment, the unit 75 is disposed below the apparatus body. Even if the liquid escaping from the unit 75, damages can be further reduced.

According to the first embodiment, the liquid amount detecting sensor 83 as the liquid amount detecting unit for detecting an amount of liquid in the tank 3 is disposed in the tank 3. It can be used as a detecting unit for detecting not only the liquid leakage but also reduction of the liquid in the system that is attributable to time degradation. The liquid replacement time can be informed to the user, and the cost is reduced.

As described above, according to the present invention, there is an excellent effect of being capable of preventing the phenomenon that good image formation cannot be performed due the vibration caused by the pulsation of the cooling liquid.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:
an image forming unit that creates an image; and
a liquid cooling unit that includes:
a heat receiving unit that is disposed in contact with a temperature rising portion, in the image forming unit, in which a temperature rises due to an image forming operation by the image forming unit,
a heat radiating unit that radiates heat of a cooling liquid,
a flow passage forming member that forms a flow passage that allows the cooling liquid to circulate between the heat receiving unit and the heat radiating unit;
a conveying unit that conveys the cooling liquid inside the flow passage forming member; and
a storage tank that stores the cooling liquid,
wherein the conveying unit and the storage unit are disposed below the heat radiating unit, wherein the conveying unit feeds the cooling liquid directly to the heat radiating unit, and the storage tank receives the cooling liquid directly from the heat receiving unit,
wherein the heat radiating unit includes a radiator, and the radiator is disposed at a downstream side of the conveying unit in a cooling liquid flow direction and at an upstream side of the heat receiving unit in the cooling liquid flow direction, and
wherein the conveying unit, the radiator, and the storage tank are disposed outside a casing of an image forming apparatus body in which the image forming unit is disposed.

2. The image forming apparatus according to claim 1, wherein the conveying unit, the radiator, and the storage tank are disposed at a further rear side of an image forming apparatus body than a casing of the image forming apparatus body in which the image forming unit is disposed.

3. The image forming apparatus according to claim 2, further comprising
a coupling member, which enables connection and disconnection between a flow passage forming member extending from the heat receiving unit and a flow passage forming member extending from a unit including the radiator, the conveying unit, and the storage tank.

4. The image forming apparatus according to claim 3, wherein a unit comprising the conveying unit, the radiator, and the storage tank is attachable to or detachable from the image forming apparatus body.

5. The image forming apparatus according to claim 4, wherein the conveying unit, the radiator, and the storage tank are disposed in a box-shaped casing as a unit.

6. The image forming apparatus according to claim 5, wherein the unit is disposed at a position that corresponds to a lower portion of the image forming apparatus body.

7. The image forming apparatus according to claim 5, wherein a liquid amount detecting unit that detects an amount of liquid in the storage tank is disposed in the storage tank.

8. The image forming apparatus according to claim 2, further comprising:
a first coupling member disposed at an upstream side of the radiator in the cooling liquid flow direction;
a second coupling member that is disposed in a flow passage forming member at an upstream side of the radiator in the cooling liquid flow direction and is connected with or disconnected from the first coupling member;
a third coupling member disposed at a downstream side of the radiator in the cooling liquid flow direction; and
a fourth coupling member that is disposed in a flow passage forming member at a downstream side of the radiator in the cooling liquid flow direction and is connected with or disconnected from the third coupling member.

9. The image forming apparatus according to claim 1, wherein the conveying unit is disposed in the image forming apparatus body with an elastic body interposed between the conveying unit and the image forming apparatus body.

10. An image forming apparatus, comprising:
an image forming unit that creates an image; and
a liquid cooling unit that includes:
a heat receiving unit that is disposed in contact with a temperature rising portion, in the image forming unit, in which a temperature rises due to an image forming operation by the image forming unit,
a heat radiating unit that radiates heat of a cooling liquid,
a flow passage forming member that forms a flow passage that allows the cooling liquid to circulate between the heat receiving unit and the heat radiating unit;
a conveying unit that conveys the cooling liquid inside the flow passage forming member;
a storage tank that stores the cooling liquid; and
a coupling member, which enables connection and disconnection between a flow passage forming member extending from the heat receiving unit and a flow passage forming member extending from a unit including the radiator, the conveying unit, and the storage tank,
wherein the heat radiating unit includes a radiator, and the radiator is disposed at a downstream side of the conveying unit in a cooling liquid flow direction and at an upstream side of the heat receiving unit in the cooling liquid flow direction,
wherein the conveying unit, the radiator, and the storage tank are disposed at a further rear side of an image forming apparatus body than a casing of the image forming apparatus body in which the image forming unit is disposed,
wherein a unit including the conveying unit, the radiator, and the storage tank is attachable to or detachable from the image forming apparatus body, and wherein a groove is formed in an installation portion in which the conveying unit, the radiator, and the storage tank of the unit are installed.

11. The image forming apparatus according to claim 10, wherein a hole is formed at the bottom of the groove, and a container is disposed below the hole.

12. The image forming apparatus according to claim 11, wherein a detecting unit that detects the presence of the cooling liquid is disposed in the container.

* * * * *